US011410624B2

(12) United States Patent
Huang

(10) Patent No.: US 11,410,624 B2
(45) Date of Patent: Aug. 9, 2022

(54) DRIVING CIRCUIT OF DISPLAY PANEL AND DISPLAY PANEL

(71) Applicant: HKC CORPORATION LIMITED, Guangdong (CN)

(72) Inventor: Xiaoyu Huang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/273,317

(22) PCT Filed: Dec. 11, 2018

(86) PCT No.: PCT/CN2018/120281
§ 371 (c)(1),
(2) Date: Mar. 4, 2021

(87) PCT Pub. No.: WO2020/107534
PCT Pub. Date: Jun. 4, 2020

(65) Prior Publication Data

US 2021/0350759 A1 Nov. 11, 2021

(30) Foreign Application Priority Data

Nov. 29, 2018 (CN) ..... 201821985999.X

(51) Int. Cl.
*G09G 3/36* (2006.01)
*G09G 3/3275* (2016.01)
(Continued)

(52) U.S. Cl.
CPC ..... *G09G 3/3677* (2013.01); *G09G 3/3233* (2013.01); *G09G 3/3275* (2013.01);
(Continued)

(58) Field of Classification Search
CPC .. G09G 3/3614; G09G 3/3696; G09G 3/3688; G09G 3/3648; G09G 2310/0251;
(Continued)

(56) References Cited

U.S. PATENT DOCUMENTS 7,936,329 B2 * 5/2011 Iriguchi ..... G09G 3/3275 345/98
8,009,134 B2 * 8/2011 Mamba ..... G09G 3/3614 345/98
(Continued)

FOREIGN PATENT DOCUMENTS

CN 104464601 A 3/2015
CN 104751766 A 7/2015
(Continued)

OTHER PUBLICATIONS

International Search Report in corresponding PCT Application No. PCT/CN2018/120281, dated Aug. 27, 2019 and Written Opinion of the International Searching Authority in corresponding PCT Application No. PCT/CN2018/120281, dated Aug. 27, 2019.

*Primary Examiner* — Dismery Mercedes

(57) ABSTRACT

Disclosed is a driving circuit of display panel. The driving circuit of display panel includes a pixel unit array, a gate driving unit, a plurality of data signal lines, a switch control unit, a plurality of first switch units and a plurality of second switch units. Each of the pixel unit columns is connected to the gate driving unit through one of the data signal lines. The switch control unit is respectively connected to each of the first switch units and each of the second switch units. When the plurality of first switch units are turned off and the plurality of second switch units are turned on, charges of each of the pixel units in the plurality of pixel unit columns are neutralized.

15 Claims, 4 Drawing Sheets

(51) Int. Cl.
*G09G 3/3291* (2016.01)
*G09G 3/3233* (2016.01)

(52) U.S. Cl.
CPC ..... *G09G 3/3291* (2013.01); *G09G 3/3614* (2013.01); *G09G 3/3685* (2013.01); *G09G 3/3688* (2013.01); *G09G 3/3696* (2013.01); *G09G 2300/0804* (2013.01); *G09G 2310/0248* (2013.01); *G09G 2310/0251* (2013.01); *G09G 2310/08* (2013.01); *G09G 2330/021* (2013.01)

(58) Field of Classification Search
CPC ..... G09G 2310/0291; G09G 2310/08; G09G 2330/021; G09G 2300/0804; G09G 2310/0275; G09G 3/3283; G09G 3/3288; G09G 3/3291; G09G 3/3233; G09G 3/3677; G09G 2300/0866
See application file for complete search history.

(56) References Cited

U.S. PATENT DOCUMENTS

| | | | | |
|---|---|---|---|---|
| 8,334,824 | B2 * | 12/2012 | Park | H02M 3/158 345/82 |
| 8,605,067 | B2 * | 12/2013 | Chen | G09G 3/3688 345/209 |
| 9,607,559 | B2 * | 3/2017 | Wen | G09G 3/3607 |
| 10,204,578 | B2 * | 2/2019 | Zhang | G09G 3/3674 |
| 10,223,988 | B2 * | 3/2019 | Hwang | G09G 3/3614 |
| 11,132,930 | B2 * | 9/2021 | Wu | G09G 3/3688 |
| 11,244,632 | B2 * | 2/2022 | Eom | G09G 3/3275 |
| 2003/0214470 | A1 * | 11/2003 | Sun | G09G 3/3655 345/87 |
| 2009/0115772 | A1 * | 5/2009 | Shiomi | G09G 3/3688 345/89 |
| 2017/0269416 | A1 * | 9/2017 | Miao | G09G 3/3688 |
| 2019/0096304 | A1 * | 3/2019 | Hu | G09G 3/20 |

FOREIGN PATENT DOCUMENTS

| | | | |
|---|---|---|---|
| CN | 108279539 | A | 7/2018 |
| CN | 108735139 | A | 11/2018 |

* cited by examiner

DRIVING CIRCUIT OF DISPLAY PANEL AND DISPLAY PANEL

CROSS-REFERENCE TO RELATED APPLICATIONS

This application is a National Stage of International Application No. PCT/CN2018/120281, filed on Dec. 11, 2018, which claims priority to Chinese Application No. 201821985999.X, filed on Nov. 29, 2018, and entitled "DRIVING CIRCUIT OF DISPLAY PANEL", the entire disclosure of which is incorporated herein by reference.

TECHNICAL FIELD

The present disclosure relates to the technical field of displays, in particular to a driving circuit of display panel.

BACKGROUND

The statements here only provide background information related to the present disclosure, and do not necessarily constitute related art.

After the data in the thin film transistor liquid crystal display is processed by the timing controller, it is output by the control circuit board. The control circuit board is respectively connected to the display panel through the source drive unit and the gate drive unit. The source drive unit outputs a data signal, and the gate drive unit outputs a scan signal. The scan signal and the data signal jointly control the pixel unit on the display panel to display and emit light and present an image.

During the process of the liquid crystal display, in order to avoid the polarization of the liquid crystal, the voltage applied to the pixel unit is switched between positive polarity and negative polarity. The working process of the display panel is to continuously charge the pixel unit from positive polarity to negative polarity, and then from negative polarity to positive polarity, and the voltage of the pixel unit is inverted. As the size of the display panel continues to increase, the load of the display panel also increases correspondingly, resulting in a substantial increase in power consumption. Therefore, how to reduce the power consumption of the display panel becomes an urgent problem to be solved.

SUMMARY

In view of this, the present disclosure discloses a driving circuit of display panel to reduce the power consumption of the display panel as the size of the display panel increases.

A driving circuit of display panel includes a pixel unit array, a data driving unit, a plurality of data signal lines, a switch control unit, a plurality of first switch units and a plurality of second switch units.

The pixel unit array includes a plurality of pixel unit columns. Each of the pixel unit columns includes a plurality of pixel units connected in series. The data driving unit is connected to the pixel unit array and charges the pixel unit array. Each of the pixel unit columns is connected to the data driving unit through one of the data signal lines. The switch control unit is respectively connected to each of the first switch units and each of the second switch units.

Each of the first switch units is connected to the data driving unit and one of the pixel unit columns through one of the data signal lines. Each of the second switch units includes a first terminal and a second terminal, the first terminal of each of the second switch units is connected to one of the pixel unit columns through one of the data signal lines, the second terminals of the plurality of second switch units is connected to each other. The switch control unit controls the plurality of first switch units to be turned on, thereby the data driving unit charges the plurality of pixel unit columns through the plurality of data signal lines; and controls the plurality of first switch units to be turned off and the plurality of second switch units to be turned on, thereby charges of each of the pixel units in the plurality of pixel unit columns are neutralized.

In an embodiment, the switch control unit includes a timing controller and a trigger, an input terminal of the trigger is connected to the timing controller, and an output terminal of the trigger is connected to the plurality of first switch units and the plurality of second switch units.

In an embodiment, the switch control unit further includes a resistor, and a terminal of the resistor is connected to one of the first switch units and one of the second switch units.

In an embodiment, the trigger includes an invert trigger.

The invert trigger includes a first invert input terminal, a second invert input terminal and a first invert output terminal. The first invert input terminal is connected to the timing controller to receive timing control. The second invert input terminal is connected to the plurality of first switch units and the plurality of second switch units to obtain a voltage signal; and the first invert output terminal is connected to the first switch unit and the second switch unit to control on and off of the first switch unit and the second switch unit.

In an embodiment, each of the first switch units includes a field effect transistor; a gate of the field effect transistor of the first switch unit is connected to the output terminal of the trigger for receiving an output voltage of the trigger; a source of the field effect transistor of the first switch unit is connected to the data driving unit through the data signal line; and a drain of the field effect transistor is connected to the pixel unit array through the data signal line for charging the pixel unit.

In an embodiment, each of the second switch units includes a field effect transistor; a gate of the field effect transistor of the second switch unit is connected to the output terminal of the trigger for receiving the output voltage of the trigger; a drain of the field effect transistor is connected to the pixel unit array through the data signal line; and sources of the field effect transistor of the second switch unit are connected to each other for neutralizing charges of the pixel unit in the plurality of pixel unit columns.

In an embodiment, field effect transistors of the plurality of first switch units are of the same type.

In an embodiment, field effect transistors of the plurality of second switch units are of the same type.

In an embodiment, the field effect transistor of the first switch unit and the field effect transistor of the second switch unit are different.

A driving circuit of display panel includes a pixel unit array, a data driving unit, a plurality of data signal lines, a timing controller, an inverter, a follower trigger, a plurality of first switch units and a plurality of second switch units.

The pixel unit array includes a plurality of pixel unit columns. Each of the pixel unit columns includes a plurality of pixel units connected in series. The data driving unit is connected to the pixel unit array and charges the pixel unit array. Each of the pixel unit columns is connected to the data driving unit through one of the data signal lines.

The follower trigger includes a first input terminal, a second input terminal and a first output terminal. The first input terminal is connected to the timing controller to receive timing control. The second input terminal is connected to the plurality of first switch units and the plurality of second switch units to obtain a voltage signal. The first output terminal is connected to the first switch unit and the second switch unit through the inverter to control on and off of the first switch unit and the second switch unit.

Each of the first switch units is connected to the data driving unit and one of the pixel unit columns through one of the data signal lines. Each of the second switch units includes a first terminal and a second terminal, the first terminal of each of the second switch units is connected to one of the pixel unit columns through one of the data signal lines, the second terminals of the plurality of second switch units is connected to each other. When the plurality of first switch units are turned on, the data driving unit charges the plurality of pixel unit columns through the plurality of data signal lines; and when the plurality of first switch units are turned off and the plurality of second switch units are turned on, charges of each of the pixel units in the plurality of pixel unit columns are neutralized.

In an embodiment, the driving circuit of display panel further includes a resistor, and a terminal of the resistor is connected to one of the first switch units and one of the second switch units.

In an embodiment, each of the first switch units includes a field effect transistor; a gate of the field effect transistor of the first switch unit is connected to the output terminal of the trigger for receiving an output voltage of the trigger; a source of the field effect transistor of the first switch unit is connected to the data driving unit through the data signal line; and a drain of the field effect transistor is connected to the pixel unit array through the data signal line for charging the pixel unit.

In an embodiment, each of the second switch units includes a field effect transistor; a gate of the field effect transistor of the second switch unit is connected to the output terminal of the trigger for receiving the output voltage of the trigger; a drain of the field effect transistor is connected to the pixel unit array through the data signal line; and sources of the field effect transistor of the second switch unit are connected to each other for neutralizing charges of the pixel unit in the plurality of pixel unit columns.

In an embodiment, field effect transistors of the plurality of first switch units are of the same type.

In an embodiment, field effect transistors of the plurality of second switch units are of the same type.

In an embodiment, the field effect transistor of the first switch unit and the field effect transistor of the second switch unit are different.

In an embodiment, the field effect transistor of the first switch unit is P-type, the field effect transistor of the second switch unit is N-type, and another terminal of the resistor is grounded.

In an embodiment, the field effect transistor of the first switch unit is N-type, the field effect transistor of the second switch unit is P-type, and another terminal of the resistor is a threshold voltage.

A display panel includes a driving circuit of display panel. The driving circuit of display panel includes: a pixel unit array, a data driving unit, a plurality of data signal lines, a switch control unit, a plurality of first switch units and a plurality of second switch units. The pixel unit array includes a plurality of pixel unit columns. Each of the pixel unit columns includes a plurality of pixel units connected in series. The data driving unit is connected to the pixel unit array and charges the pixel unit array. Each of the pixel unit columns is connected to the data driving unit through one of the data signal lines. The switch control unit is respectively connected to each of the first switch units and each of the second switch units.

Each of the first switch units is connected to the data driving unit and one of the pixel unit columns through one of the data signal lines. Each of the second switch units includes a first terminal and a second terminal, the first terminal of each of the second switch units is connected to one of the pixel unit columns through one of the data signal lines, the second terminals of the plurality of second switch units is connected to each other. The switch control unit controls the plurality of first switch units to be turned on, thereby the data driving unit charges the plurality of pixel unit columns through the plurality of data signal lines; and controls the plurality of first switch units to be turned off and the plurality of second switch units to be turned on, thereby charges of each of the pixel units in the plurality of pixel unit columns are neutralized.

In an embodiment, the switch control unit includes a timing controller and a trigger, an input terminal of the trigger is connected to the timing controller, and an output terminal of the trigger is connected to the plurality of first switch units and the plurality of second switch units.

The present disclosure discloses a driving circuit of display panel, including: a pixel unit array, a plurality of data signal lines, a data driving unit, a switch control unit, a plurality of first switch units, and a plurality of second switch units. The pixel unit array includes a plurality of pixel unit columns. Each of the pixel unit columns includes a plurality of pixel units connected in series. Each of the pixel unit columns is connected to the data driving unit through one of the data signal lines. The switch control unit is respectively connected with each of the first switch units and each of the second switch units. When the switch control unit controls the plurality of first switch units to be turned on, the data driving unit charges the plurality of pixel unit columns through the plurality of data signal lines. When the plurality of first switch units are turned off, the plurality of second switch units are turned on, and a charge of the pixel unit in the plurality of pixel unit columns are neutralized. By neutralizing the charge of the pixel unit, the charging voltage difference required for the charge inversion of the pixel unit can be reduced. The voltage difference required for charging is reduced, which shortens the charging time required for the voltage inversion of the pixel unit, and reduces the power consumption of the display panel.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

The embodiments of the present application disclose a display panel drive circuit to reduce the power consumption of the display panel as the size of the display panel increases.

Figure 1:
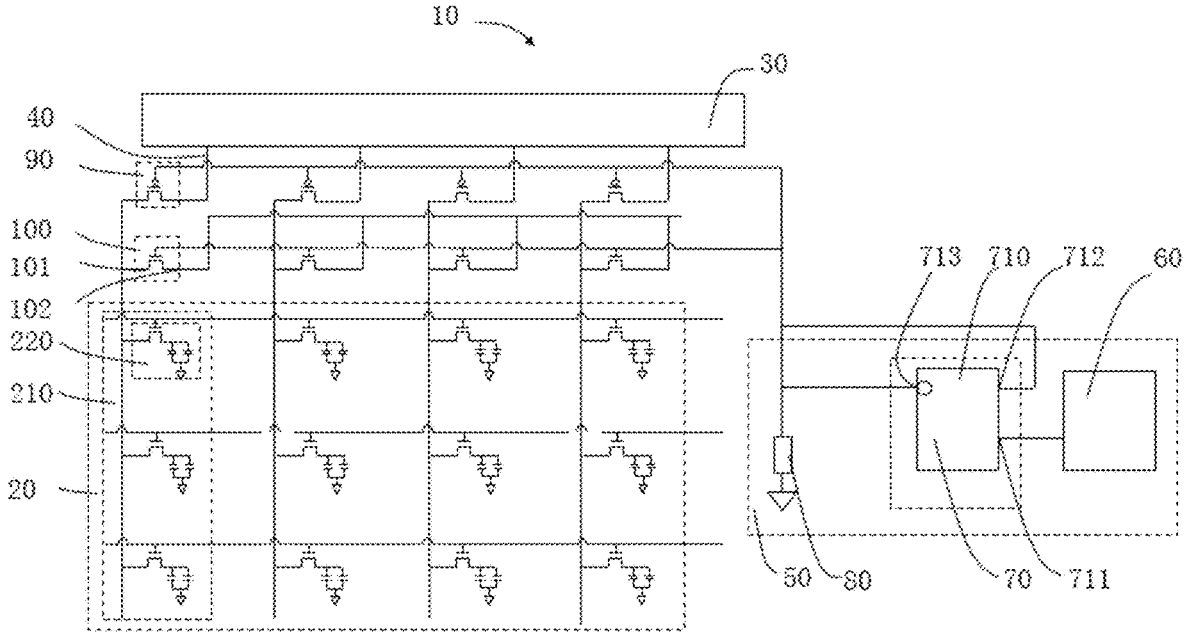
FIG. 1 is a schematic structural diagram of a driving circuit of display panel according to an embodiment of the present disclosure.

As shown in FIG. 1, an embodiment of the present disclosure provides a driving circuit of display panel 10, including a pixel unit array 20, a data driving unit 30, a plurality of data signal lines 40, a switch control unit 50, a plurality of first switch units 90, and a plurality of second switch units 100. The pixel unit array 20 includes a plurality of pixel unit columns 210. Each of the pixel unit columns 210 includes a plurality of pixel units 220 connected in series. The data driving unit 30 is connected to the pixel unit array 20 to charge the pixel unit array 20. Each of the pixel unit columns 210 is connected to the data driving unit 30 through one of the data signal lines 40. The switch control unit 50 is respectively connected with each of the first switch units 90 and each of the second switch units 100.

Each of the first switch units 90 is connected between the data driving unit 30 and one of the pixel unit columns 210 through one of the data signal lines 40. Each of the second switch units 100 includes a first terminal 101 and a second terminal 102. The first terminal 101 of each of the second switch units 100 is connected to one of the pixel unit columns 210 through one of the data signal lines 40. The second terminals 102 of the plurality of second switch units 100 are connected to each other. When the plurality of first switch units 90 are turned on, the data driving unit 30 charges the plurality of pixel unit columns 210 through the plurality of data signal lines 40. When the plurality of first switch units 90 are turned off, and the plurality of second switch units 100 are turned on, charges of the pixel units 220 in the plurality of pixel unit columns 210 are neutralized.

During the process of the liquid crystal display, in order to avoid the polarization of the liquid crystal, the voltage applied to the pixel unit is switched between positive polarity and negative polarity. The working process of the display panel is to continuously charge the pixel unit 220 from positive polarity to negative polarity, and then from negative polarity to positive polarity. There is a non-charging time when the positive electrode and negative electrode of the pixel unit 220 are turned over. During the non-charging time, the data driving unit 30 reads data signals from the control panel. The driving circuit of display panel 10 controls the plurality of first switch units 90 to be turned off, and the plurality of second switch units 100 to be turned on, the charges of the pixel units 220 in the plurality of pixel unit columns 210 are neutralized. By neutralizing the charges of the pixel unit 220, the charging voltage difference required for the charge inversion of the pixel unit 220 is reduced. The voltage difference required for charging is reduced, so that the required charging time for the charge inversion of the pixel unit 220 is shortened, and the overall power consumption of the display panel is reduced. Meanwhile, since the required charging time is shortened, the display efficiency of the display panel is improved.

The display area of the display panel includes a plurality of pixel units 220. The pixel units 220 are orderly arranged in the form of an array to form the pixel unit array 20. The data driving unit 30 transfers charges to the pixel unit column 210 through a plurality of the data signal lines 40. The charges on the pixel unit columns 210 are the same, that is, the types of charges that the data signal line 40 transmits to the pixel units 220 connected in series on a single pixel unit column 210 are the same. The charges of the adjacent pixel unit columns 210 may be the same or different. In an embodiment, the pixel unit columns 210 in the pixel unit array 20 are arranged in a form of three positive and three negative.

In an embodiment, each of the first switch units 90 is connected in series to each of the data signal lines 40. The first switch unit 90 can control the on and off between the data driving unit 30 and the pixel unit column 210, that is, control whether the data driving unit 30 charges the pixel unit column 210. When the first switch unit 90 is turned on, the data driving unit 30 charges the pixel unit column 210; and when the first switch unit 90 is turned off, the data driving unit 30 stops charging the pixel unit column 210. In an embodiment, the pixel unit columns 210 in the pixel unit array 20 are arranged in a form of three positives and three negatives. Every three positive data signal lines 40 can be connected in series with one first switch unit 90. Every three negative data signal lines 40 can be connected in series with another first switch unit 90. The adjacent pixel unit columns 210 having the same polarity share one first switch unit 90, which increases the synchronization of the same polarity charging.

In an embodiment, a charging cycle for the data driving unit 30 to charge the pixel unit array 20 includes four time periods. The four time periods include a first time period, a second time period, a third time period, and a fourth time period.

When the first switch unit 90 is turned on, the data driving unit 30 charges three adjacent pixel unit columns 210. When the first switch unit 90 is turned off, the data driving unit 30 stops charging the three adjacent pixel unit columns 210. In the first time period, the data driving unit 30 positively charges the $n-3^{th}$, $n-2^{th}$, and $n-1^{th}$ pixel unit columns 210 through the data signal line 40, the data driving unit 30 negatively charges the $n^{th}$, $n+1^{th}$, and $n+2^{th}$ pixel unit columns 210 through the data signal line 40. In the second time period, the data driving unit 30 stops charging the pixel unit column 210 and starts to read data. In the third time period, the data driving unit 30 negatively charges the $n-3^{th}$, $n-2^{th}$, and $n-1^{th}$ pixel unit columns 210 through the data signal line 40, the data driving unit 30 positively charges the $n^{th}$, $n+1^{th}$, and $n+2^{th}$ pixel unit columns 210 through the data signal line 40. In the fourth time period, the data driving unit 30 stops charging the pixel unit column 210 and starts to read data. The display process of the display panel is a process realized by countless charging cycles.

The first terminal 101 of each of the second switch units 100 is connected to one of the pixel unit columns 210 through one of the data signal lines 40, and the second terminals 102 of the plurality of second switch units 100 are connected to each other. When the second switch unit 100 is turned on, the pixel unit column 210 is turned on through the second terminal. Since the charges in all the pixel unit columns 210 are not the same, the positive and negative are arranged in an orderly manner. When all the pixel unit columns 210 are connected, the charges in the pixel units 220 move along the pixel unit column 210, and are collected and neutralized. The voltage of each of the pixel unit columns 210 is neutralized and is closer to the voltage to be switched, the voltage difference is reduced, and the time for the voltage inversion is also shortened, which improves the driving efficiency of the data driving unit 30.

In an embodiment, the switch control unit 50 includes a timing controller 60 and a trigger 70. The input terminal of the trigger 70 is connected to the timing controller 60, and the output terminal of the trigger 70 is connected to the plurality of first switch units 90 and the plurality of second switch units 100.

The timing controller 60 can provide timing conversion, that is, provide a high level and a low level in different time periods. When the low level changes to a high level, a rising edge is generated; when the high level changes to a low level, a falling edge is generated. The trigger 70 includes a signal receiving terminal, a voltage input terminal and a voltage output terminal. The signal receiving terminal of the trigger 70 can receive the rising edge and the falling edge. Each time the signal receiving terminal of the trigger 70 receives the rising edge or the falling edge, the voltage input terminal of the trigger 70 will read a voltage once, and the voltage output terminal will output a corresponding voltage according to an internal setting. When the high level and low level output by the timing controller 60 change orderly, rising and falling edges will appear sequentially, the voltage output terminal of the terminal 70 will sequentially orderly change high and low levels.

The voltage output terminal of the trigger 70 is connected to the control signal terminals of the plurality of first switch units 90 and the plurality of second switch units 100. When the voltage output terminal of the trigger 70 outputs a low level, the plurality of first switch units 90 are turned on, the plurality of second switch units 100 are turned off, and the data driving unit 30 charges the pixel unit column 210. When the voltage output terminal of the trigger 70 outputs a high level, the plurality of first switch units 90 are turned off, and the plurality of second switch units 100 are turned on, the data driving unit 30 stops charging the three adjacent pixel unit columns 210, and all the pixel unit columns 210 are connected, the charges in the pixel units 220 move along the pixel unit column 210, and are collected and neutralized. The voltage of each pixel unit column 210 is neutralized and is closer to the voltage to be switched, the voltage difference is reduced, and the time for the voltage inversion is also shortened, which improves the driving efficiency of the data driving unit 30.

In an embodiment, the switch control unit 50 further includes a resistor 80. A terminal of the resistor 80 is connected to the first switch unit 90 and the second switch unit 100. The resistor 80 can provide an initial voltage for the voltage input terminal of the trigger 70.

The control signal terminals of the first switch unit 90 and the second switch unit 100 are connected to the voltage output terminal of the trigger 70. The voltage input terminal of the trigger 70 is connected between the control signal terminals of the first switch unit 90 and the second switch unit 100 and the voltage output terminal of the trigger 70. A terminal of the resistor 80 is connected to the voltage output terminal of the trigger 70, and another terminal is grounded. When current flows through the resistor 80, a voltage difference is formed across the resistor 80. Since another terminal of the resistor 80 is grounded, the voltage value at one terminal of the resistor 80 is the value of the voltage difference applied across the resistor 80. The voltage at the voltage output terminal of the trigger 70 is equal to the voltage difference between the two terminals of the resistor 80. The resistor 80 can provide an initial voltage for the voltage input terminal of the trigger 70.

In an embodiment, the trigger 70 includes an invert trigger 710. The invert trigger 710 includes a first invert input terminal 711, a second invert input terminal 712, and a first invert output terminal 713. The first invert input terminal 711 is connected to the timing controller 60 and receives timing control. The second invert input terminal 712 is connected to the plurality of first switch units 90 and the plurality of second switch units 100 to obtain voltage signals. The first invert output terminal 713 is connected to the first switch unit 90 and the second switch unit 100, and controls the on and off of the first switch unit 90 and the second switch unit 100.

The invert trigger 710 can achieve voltage inversion, that is, when the second invert input terminal 712 inputs a low level, the first invert output terminal 713 outputs a high level. When the second invert input terminal 712 inputs a high level, the first invert output terminal 713 outputs a low level. In an embodiment, the control signal terminal of the first switch unit 90, the second switch unit 100, and the second invert input terminal 712 are all low level. The first switch unit 90 is turned on, and the second switch unit 100 is turned off. At this time, the data driving unit 30 charges the plurality of pixel unit columns 210 through the data signal line 40. When the timing controller 60 changes from low level to high level, a rising edge occurs. The first invert input terminal 711 receives the rising edge, and the first invert output terminal 713 receives the low level of the second invert input terminal 712 and inverts to a high level output.

The first invert output terminal 713 is connected to the first switch unit 90 and the second switch unit 100. The control signal terminals of the plurality of first switch units 90 and the plurality of second switch units 100 receive a high level. The plurality of first switch units 90 are turned off, and the plurality of second switch units 100 are turned on. The data driving unit 30 stops charging the pixel unit column 210, and all the pixel unit columns 210 are connected. The charges in the pixel unit 220 move along the pixel unit column 210, and are collected and neutralized. The voltage of each pixel unit column 210 is neutralized, and the pixel unit 220 is 0V.

When the timing controller 60 changes from a high level to a low level, a falling edge occurs. The first invert input terminal 711 receives the falling edge, the first invert output terminal 713 receives the high level of the second invert input terminal 712 and inverts it to a low level for output. The first invert output terminal 713 is connected to the first switch unit 90 and the second switch unit 100, the control signal terminals of the plurality of first switch units 90 and the plurality of second switch units 100 receive a low level. The plurality of first switch units 90 are turned on, and the plurality of second switch units 100 are turned off. The data driving unit 30 charges the pixel unit column 210, and the pixel unit 220 changes from 0V to a set voltage.

Figure 2:
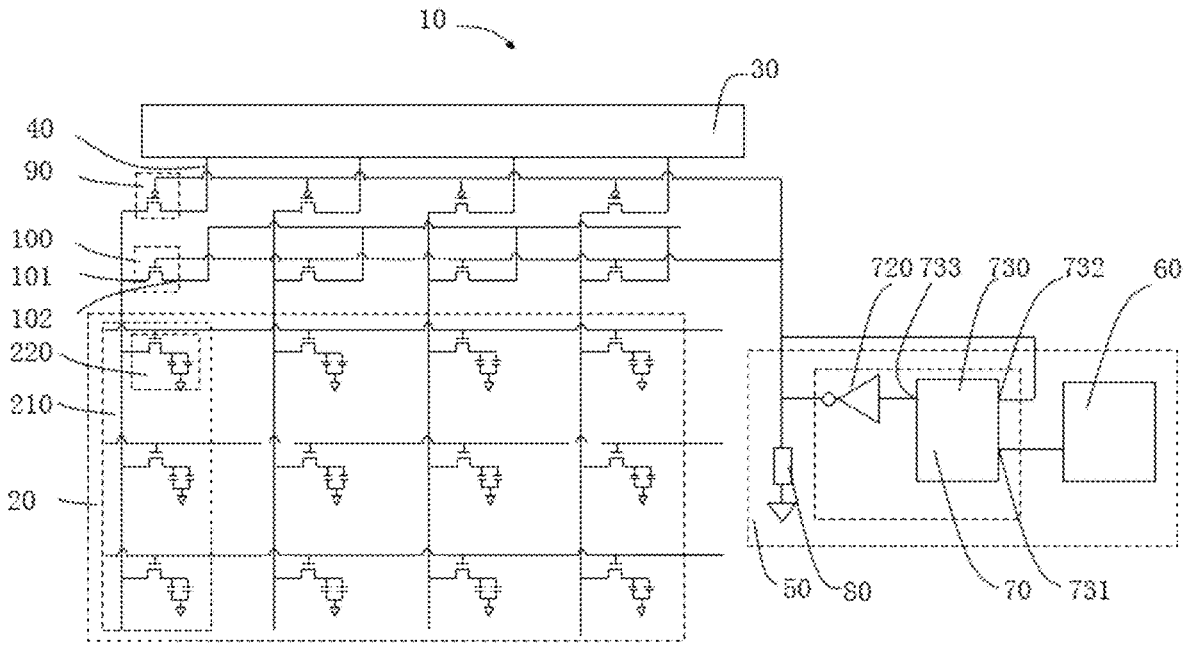
FIG. 2 is a schematic structural diagram of the driving circuit of display panel according to another embodiment of the present disclosure.

As shown in FIG. 2, in an embodiment, the trigger 70 includes an inverter 720 and a follower trigger 730. The follower trigger 730 includes a first input terminal 731, a second input terminal 732 and a first output terminal 733. The first input terminal 731 is connected to the timing controller 60 and receives timing control. The second input terminal 732 is connected to the plurality of first switch units 90 and the plurality of second switch units 100 to obtain voltage signals. The first output terminal 733 is connected to the first switch unit 90 and the second switch unit 100 through the inverter 720, to control the on and off of the first switch unit 90 and the second switch unit 100.

The inverter 720 and the follower trigger 730 are connected in series to achieve voltage inversion. When the second input terminal 732 of the follower trigger 730 inputs a low level, the first output terminal 733 outputs a low level. When the second input terminal 732 inputs a high level, the first output terminal 733 outputs a high level. The inverter 720 can realize voltage inversion, that is, input low level and output high level; or input high level and output low level. The first output terminal 733 of the follower trigger 730 is connected to the inverter 720 to achieve voltage inversion.

In an embodiment, the control signal terminals of the first switch unit 90 and the second switch unit 100, and the second invert input terminal 712 are all low level. When the first input terminal 731 inputs a rising edge, the second input terminal 732 assigns a low level to the first input terminal 731, the first input terminal 731 transmits a low level to the inverter 720. The inverter 720 outputs a high level. The control signal terminals of the plurality of first switch units 90 and the plurality of second switch units 100 receive a high level. The plurality of first switch units 90 are turned off, and the plurality of second switch units 100 are turned on. The data driving unit 30 stops charging the pixel unit column 210, and all the pixel unit columns 210 are connected. The charges in the pixel units 220 move along the pixel unit column 210, and are collected and neutralized. The voltage of each pixel unit column 210 is neutralized, and the voltage in the pixel unit 220 is 0V.

When the timing controller 60 changes from a high level to a low level, a falling edge occurs. The first input terminal 731 receives the falling edge, and the first output terminal 733 receives the high level of the second input terminal 732 and outputs a high level. The inverter 720 receives a high level and inverts it to a low level for output. The first invert output terminal 713 is connected to the first switch unit 90 and the second switch unit 100, the control signal terminals of the plurality of first switch units 90 and the plurality of second switch units 100 receive a low level. The plurality of first switch units 90 are turned on, and the plurality of second switch units 100 are turned off. The data driving unit 30 charges the pixel unit column 210, and the pixel unit 220 changes from 0V to a set voltage.

In the previous embodiment, the plurality of first switch units 90 are field effect transistors, the gate of the field effect transistor of the first switch unit 90 is connected to the output terminal of the trigger 70 for receiving the output voltage of the trigger 70. The source of the field effect transistor of the first switch unit 90 is connected to the data driving unit 30 through the data signal line 40, the drain of the field effect transistor is connected to the pixel unit array 20 through the data signal line 40 for charging the pixel unit 220.

In an embodiment, the second switch unit 100 is a field effect transistor, the gate of the field effect transistor of the second switch unit 100 is connected to the output terminal of the trigger 70 for receiving the output voltage of the trigger 70. The drain of the field effect transistor is connected to the pixel unit array 20 through the data signal line 40, the sources of the field effect transistors of the second switch unit 100 are connected to each other, and are used to neutralize the charge of the pixel units 220 in the plurality of pixel unit columns 210.

In an embodiment, the field effect transistors of the plurality of first switch units 90 are of the same type, the field effect transistors of the plurality of second switch units 100 are of the same type and different from the field effect transistors of the first switch unit 90.

In the previous embodiment, the field effect transistor of the first switch unit 90 is P-type, the field effect transistor of the second switch unit 100 is N-type, and another terminal of the resistor 80 is grounded. When the gate of the P-type field effect transistor is at a low level, the P-type field effect transistor is turned on. The data driving unit 30 charges the pixel unit column 210. When the gate of the P-type field effect transistor is at a high level, the P-type field effect transistor is turned off. The data driving unit 30 stops charging the pixel unit column 210. When the gate of the N-type field effect transistor is at a high level, the N-type field effect transistor is turned on. The second terminals 102 of all the pixel unit columns 210 are connected, and the charge of the electrode unit 220 is neutralized, and the voltage is 0V. When the gate of the N-type field effect transistor is at a low level, the N-type field effect transistor is turned off. The second terminals 102 of all the pixel unit columns 210 are turned off.

In an initial state, the gates of the P-type field effect transistor, the N-type field effect transistor and the second invert input terminal 712 are all at a low level. When the first input terminal 731 inputs a rising edge, the second input terminal 732 assigns a low level to the first input terminal 731, the first input terminal 731 transmits a low level to the inverter 720. The inverter 720 outputs a high level. The gates of the plurality of P-type field effect transistors and the plurality of N-type field effect transistors receive a high level. The plurality of P-type field effect transistors are turned off, and the plurality of N-type field effect transistors are turned on. The data driving unit 30 stops charging the pixel unit column 210, and all the pixel unit columns 210 are connected, the charge in the pixel unit 220 moves along the pixel unit column 210, and is collected and neutralized. The voltage of each pixel unit column 210 is neutralized, and the voltage in the pixel unit 220 is 0V.

When the timing controller 60 changes from a high level to a low level, a falling edge occurs. The first input terminal 731 receives the falling edge, and the first output terminal 733 receives the high level of the second input terminal 732 and outputs a high level. The inverter 720 receives a high level and inverts it to a low level for output. The first invert output terminal 713 is connected to the P-type field effect transistor and the N-type field effect transistor, the gates of the plurality of P-type field effect transistors and the plurality of N-type field effect transistors receive a low level. The plurality of P-type field effect transistors are turned on, and the plurality of N-type field effect transistors are turned off. The data driving unit 30 charges the pixel unit column 210, and the pixel unit 220 is changed from 0V to a set voltage, which shortens the charging time and improves the page display efficiency.

In an embodiment, the field effect transistor of the first switch unit 90 is N-type, the field effect transistor of the second switch unit 100 is P-type, and another terminal of the resistor 80 is at least the threshold voltage of the field effect transistor. Since the initial voltage is the threshold voltage of the field effect transistor, it is a high level. The control signal terminal of the N-type field effect transistor is at a high level, and the N-type field effect transistor is turned on; the control signal terminal of the P-type field effect transistor is at a high level, and the P-type field effect transistor is turned off. The data driving unit 30 charges the pixel unit column 210.

When the first input terminal 731 inputs a rising edge, the second input terminal 732 assigns a high level to the first input terminal 731, the first input terminal 731 transmits a high level to the inverter 720. The inverter 720 outputs a low level. The control signal terminals of the plurality of P-type field effect transistors and the plurality of P-type field effect transistors receive a low level. The plurality of P-type field effect transistors are turned off, and the plurality of P-type field effect transistors are turned on. The data driving unit 30 stops charging the pixel unit column 210, and all the pixel unit columns 210 are connected, the charge in the pixel unit 220 moves along the pixel unit column 210, and is collected and neutralized. The voltage of each pixel unit column 210 is neutralized, and the voltage in the pixel unit 220 is 0V.

When the timing controller 60 changes from low level to high level, a falling edge occurs. The first input terminal 731 receives the falling edge, and the first output terminal 733 receives the low level of the second input terminal 732 and outputs a low level. The inverter 720 receives a low level and inverts it to a high level for output. The first invert output terminal 713 is connected to the P-type field effect transistor and the P-type field effect transistor, the control signal terminals of the plurality of P-type field effect transistors and the plurality of P-type field effect transistors receive a high level. The plurality of P-type field effect transistors are turned on, and the plurality of P-type field effect transistors are turned off. The data driving unit 30 charges the pixel unit column 210, and the pixel unit 220 is changed from 0V to a set voltage, which shortens the charging time and improves the page display efficiency.

Figure 3:
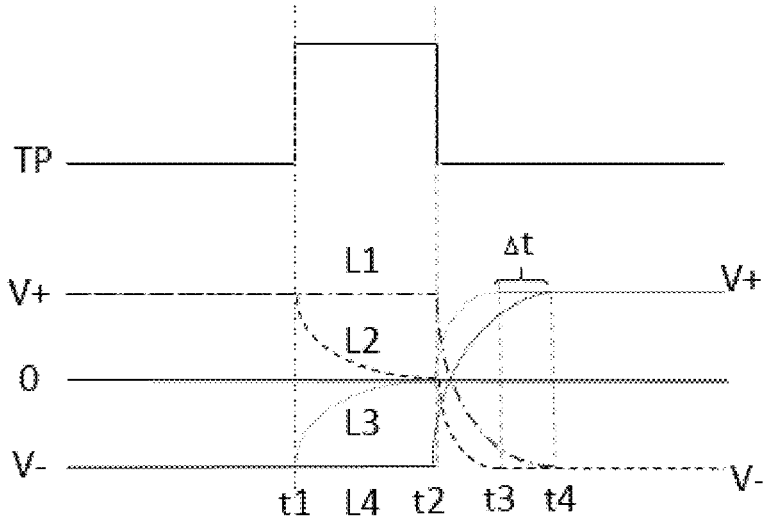
FIG. 3 is a diagram showing a relationship between time and voltage of the driving circuit of display panel according to an embodiment of the present disclosure.

As shown in FIG. 3, in an embodiment, L1 and L4 are the process curves of the voltage inversion of the pixel unit 220, and L2, L3 are the process curves of the voltage inversion of the pixel unit 220 described in the present disclosure. In the previous embodiment, the inverted voltage difference of the pixel unit column 210 is 2V, and the voltage inversion time of L1 and L4 is a period of time t2 to t4. The voltage inversion process of the driving circuit of display panel 10 is as follows: at time t1, the timing controller 60 changes from a low level to a high level, and a rising edge occurs. When the first input terminal 731 inputs a rising edge, the second input terminal 732 assigns a low level to the first input terminal 731, the first input terminal 731 transmits a low level to the inverter 720. The inverter 720 outputs a high level. The gates of the plurality of P-type field effect transistors and the plurality of N-type field effect transistors receive a high level. The plurality of P-type field effect transistors are turned off, and the plurality of N-type field effect transistors are turned on. The data driving unit 30 stops charging the pixel unit column 210, and all the pixel unit columns 210 are connected. The charge in the pixel unit 220 moves along the pixel unit column 210, and is collected and neutralized.

At time t2, the pixel unit 220 achieves charge neutralization. L2 and L3 are 0V. At time t2, when the timing controller 60 changes from a high level to a low level, a falling edge occurs. The first input terminal 731 receives the falling edge, and the first output terminal 733 receives a high level of the second input terminal 732 and outputs the high level. The inverter 720 receives the high level and inverts it to a low level for output. The first invert output terminal 713 is connected to the P-type field effect transistor and the N-type field effect transistor, the gates of the plurality of P-type field effect transistors and the plurality of N-type field effect transistors receive a low level. The plurality of P-type field effect transistors are turned on, and the plurality of N-type field effect transistors are turned off. The data driving unit 30 charges the pixel unit column 210, and the pixel unit 220 becomes the set voltage during the time period from t2 to t3, and L2 and L3 change from 0V to the set voltage. Compared with the traditional technology, the solution in present disclosure shortens the time for voltage inversion by Δt, shortens the charging time, and improves the page display efficiency.

Figure 4:
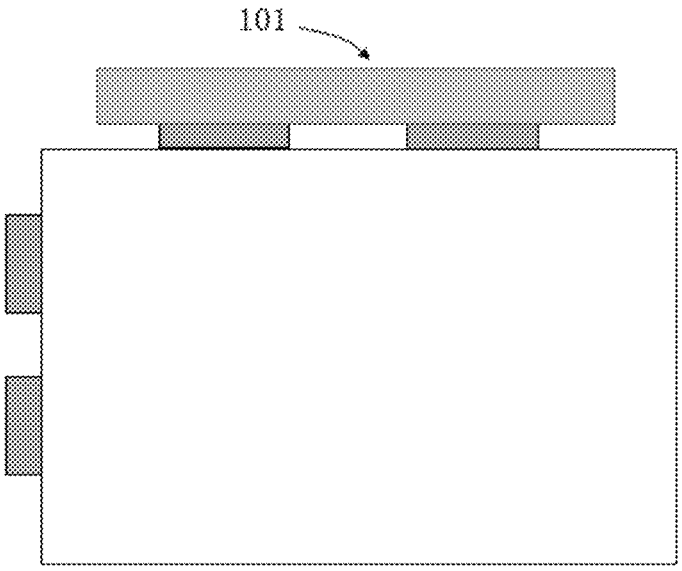
FIG. 4 is a schematic structural diagram of a display panel according to an embodiment of the present disclosure.

As shown in FIG. 4, a display panel 101 includes a driving circuit of display panel 10. The driving circuit of display panel 10 includes: a pixel unit array 20, a data driving unit 30, a plurality of data signal lines 40, a switch control unit 50, a plurality of first switch units 90 and a plurality of second switch units 100. The pixel unit array 20 includes a plurality of pixel unit columns 210. Each of the pixel unit columns 210 includes a plurality of pixel units 220 connected in series. The data driving unit 30 is connected to the pixel unit array 20 to charge the pixel unit array 20. Each of the pixel unit columns 210 is connected to the data driving unit 30 through one of the data signal lines 40. The switch control unit 50 is connected to each of the first switch units 90 and each of the second switch units 100 respectively.

Each of the first switch units 90 is connected between the data driving unit 30 and one of the pixel unit columns 210 through one of the data signal lines 40. Each of the second switch units 100 includes a first terminal 101 and a second terminal 102. The first terminal 101 of each of the second switch units 100 is connected to one of the pixel unit columns 210 through one of the data signal lines 40. The second terminals 102 of the plurality of second switch units 100 are connected to each other. When the plurality of first switch units 90 are turned on, the data driving unit 30 charges the plurality of pixel unit columns 210 through the plurality of data signal lines 40. When the plurality of first switch units 90 are turned off, and the plurality of second switch units 100 are turned on, a charge of the pixel unit 220 in the plurality of pixel unit columns 210 is neutralized.

The switch control unit 50 includes a timing controller 60 and a trigger 70. The input terminal of the trigger 70 is connected to the timing controller 60, and the output terminal of the trigger 70 is connected to the plurality of first switch units 90 and the plurality of second switch units 100.

Finally, it should be noted that in this document, relational terms such as first and second are only used to distinguish one entity or operation from another entity or operation and it does not necessarily require or imply any such actual relationship or order between these entities or operations. Moreover, the terms "comprise", "include" or any other variations thereof are intended to cover non-exclusive inclusion, such that a process, method, article, or device that includes a series of elements includes not only those elements, but also other elements that are not explicitly listed, or include elements inherent to the process, method, article, or device. If there are no more restrictions, the element defined by the sentence "including a . . . " does not exclude the existence of other same elements in the process, method, article, or device including the element.

The various embodiments in this specification are described in a progressive manner, each embodiment focuses on the differences from other embodiments, and the same or similar parts between the various embodiments can be referred to each other.

The foregoing description of the disclosed embodiments enables those skilled in the art to implement or use the present disclosure. Various modifications to these embodiments will be obvious to those skilled in the art, and the general principles defined in this document can be implemented in other embodiments without departing from the spirit or scope of the present disclosure. Therefore, the present disclosure will not be limited to the embodiments shown in this document, but should conform to the widest scope consistent with the principles and novel features disclosed in this document.

What is claimed is:

1. A driving circuit of display panel, comprising:

a pixel unit array comprising a plurality of pixel unit columns, each of the pixel unit columns comprising a plurality of pixel units connected in series;

a data driving unit connected to the pixel unit array and for charging the pixel unit array;

a plurality of data signal lines, each of the pixel unit columns connected to the data driving unit through one of the data signal lines;

a plurality of first switch units, each of the first switch units connected to the data driving unit and one of the pixel unit columns through one of the data signal lines;

a plurality of second switch units, each of the second switch units comprising a first terminal and a second terminal, the first terminal of each of the second switch units connected to one of the pixel unit columns through one of the data signal lines, the second terminals of the plurality of second switch units connected to each other; and a switch control unit respectively connected to each of the first switch units and each of the second switch units;

wherein the switch control unit controls the plurality of first switch units to be turned on, thereby the data driving unit charges the plurality of pixel unit columns through the plurality of data signal lines, and controls the plurality of first switch units to be turned off and the plurality of second switch units to be turned on, thereby charges of each of the pixel units in the plurality of pixel unit columns are neutralized;

the switch control unit comprises a timing controller and a trigger, an input terminal of the trigger is connected to the timing controller, and an output terminal of the trigger is connected to the plurality of first switch units and the plurality of second switch units;

the switch control unit further comprises a resistor, and a terminal of the resistor is connected to one of the first switch units and one of the second switch units;

the trigger comprises an invert trigger;

the invert trigger comprises a first invert input terminal, a second invert input terminal and a first invert output terminal;

the first invert input terminal is connected to the timing controller to receive timing control;

the second invert input terminal is connected to the plurality of first switch units and the plurality of second switch units to obtain a voltage signal; and the first invert output terminal is connected to the first switch unit and the second switch unit to control on and off of the first switch unit and the second switch unit.

2. The driving circuit of display panel of claim 1, wherein:

each of the first switch units comprises a field effect transistor;

a gate of the field effect transistor of the first switch unit is connected to the output terminal of the trigger for receiving an output voltage of the trigger;

a source of the field effect transistor of the first switch unit is connected to the data driving unit through the data signal line; and a drain of the field effect transistor is connected to the pixel unit array through the data signal line for charging the pixel unit.

3. The driving circuit of display panel of claim 2, wherein:

each of the second switch units comprises a field effect transistor;

a gate of the field effect transistor of the second switch unit is connected to the output terminal of the trigger for receiving the output voltage of the trigger;

a drain of the field effect transistor is connected to the pixel unit array through the data signal line; and sources of the field effect transistor of the second switch unit are connected to each other for neutralizing charges of the pixel unit in the plurality of pixel unit columns.

4. The driving circuit of display panel of claim 3, wherein field effect transistors of the plurality of first switch units are of the same type.

5. The driving circuit of display panel of claim 4, wherein field effect transistors of the plurality of second switch units are of the same type.

6. The driving circuit of display panel of claim 5, wherein the field effect transistor of the first switch unit and the field effect transistor of the second switch unit are different.

7. A driving circuit of display panel, comprising:

a pixel unit array comprising a plurality of pixel unit columns, each of the pixel unit columns comprising a plurality of pixel units connected in series;

a data driving unit connected to the pixel unit array and for charging the pixel unit array;

a plurality of data signal lines, each of the pixel unit columns connected to the data driving unit through one of the data signal lines;

a timing controller;

an inverter;

a follower trigger comprising a first input terminal, a second input terminal and a first output terminal, the first input terminal connected to the timing controller to receive timing control, the second input terminal connected to the plurality of first switch units and the plurality of second switch units to obtain a voltage signal, the first output terminal connected to the first switch unit and the second switch unit through the inverter to control on and off of the first switch unit and the second switch unit;

a plurality of first switch units, each of the first switch units connected to the data driving unit and one of the pixel unit columns through one of the data signal lines; and a plurality of second switch units, each of the second switch units comprising a first terminal and a second terminal, the first terminal of each of the second switch units connected to one of the pixel unit columns through one of the data signal lines, the second terminals of the plurality of second switch units connected to each other; and wherein when the plurality of first switch units are turned on, the data driving unit charges the plurality of pixel unit columns through the plurality of data signal lines, and when the plurality of first switch units are turned off, and the plurality of second switch units are turned on, charges of each of the pixel units in the plurality of pixel unit columns are neutralized.

8. The driving circuit of display panel of claim 7, further comprising:

a resistor, a terminal of the resistor connected to one of the first switch units and one of the second switch units.

9. The driving circuit of display panel of claim 8, wherein:

each of the first switch units comprises a field effect transistor;

a gate of the field effect transistor of the first switch unit is connected to the output terminal of the trigger for receiving an output voltage of the trigger;

a source of the field effect transistor of the first switch unit is connected to the data driving unit through the data signal line; and a drain of the field effect transistor is connected to the pixel unit array through the data signal line for charging the pixel unit.

10. The driving circuit of display panel of claim 9, wherein:

each of the second switch units comprises a field effect transistor;

a gate of the field effect transistor of the second switch unit is connected to the output terminal of the trigger for receiving the output voltage of the trigger;

a drain of the field effect transistor is connected to the pixel unit array through the data signal line; and sources of the field effect transistor of the second switch unit are connected to each other for neutralizing charges of the pixel unit in the plurality of pixel unit columns.

11. The driving circuit of display panel of claim 10, wherein field effect transistors of the plurality of first switch units are of the same type.

12. The driving circuit of display panel of claim 11, wherein field effect transistors of the plurality of second switch units are of the same type.

13. The driving circuit of display panel of claim 12, wherein the field effect transistor of the first switch unit and the field effect transistor of the second switch unit are different.

14. The driving circuit of display panel of claim 13, wherein the field effect transistor of the first switch unit is P-type, the field effect transistor of the second switch unit is N-type, and another terminal of the resistor is grounded.

15. The driving circuit of display panel of claim 13, wherein the field effect transistor of the first switch unit is N-type, the field effect transistor of the second switch unit is P-type, and another terminal of the resistor is a threshold voltage.

* * * * *